US011054767B2

(12) United States Patent
Takahashi et al.

(10) Patent No.: US 11,054,767 B2
(45) Date of Patent: Jul. 6, 2021

(54) NIP FORMATION MEMBER, HEATING DEVICE, FIXING DEVICE AND IMAGE FORMING APPARATUS

(71) Applicants: Yoshiharu Takahashi, Tokyo (JP); Hiroyuki Shimada, Tokyo (JP); Hitoshi Fujiwara, Kanagawa (JP)

(72) Inventors: Yoshiharu Takahashi, Tokyo (JP); Hiroyuki Shimada, Tokyo (JP); Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/908,837

(22) Filed: Jun. 23, 2020

(65) Prior Publication Data

US 2021/0026279 A1 Jan. 28, 2021

(30) Foreign Application Priority Data

Jul. 25, 2019 (JP) ..... JP2019-136810
May 12, 2020 (JP) ..... JP2020-083917

(51) Int. Cl.
*G03G 15/20* (2006.01)

(52) U.S. Cl.
CPC ..... *G03G 15/2017* (2013.01); *G03G 15/2053* (2013.01)

(58) Field of Classification Search
CPC ..... G03G 15/2017; G03G 15/2053; G03G 15/2064
See application file for complete search history.

(56) References Cited

U.S. PATENT DOCUMENTS

2011/0116848 A1* 5/2011 Yamaguchi ..... G03G 15/2064 399/329
2018/0284669 A1 10/2018 Fujimoto et al.

FOREIGN PATENT DOCUMENTS

JP 2016-200802 12/2016

OTHER PUBLICATIONS

U.S. Appl. No. 16/750,066, filed Jan. 23, 2020, Hitoshi Fujiwara.
U.S. Appl. No. 16/794,976, filed Feb. 19, 2020, Ryohei Matsuda, et al.
U.S. Appl. No. 16/811,955, filed Mar. 6, 2020, Yoshiharu Takahashi, et al.

* cited by examiner

*Primary Examiner* — Hoang X Ngo
(74) *Attorney, Agent, or Firm* — Oblon, McClelland, Maier & Neustadt, L.L.P.

(57) ABSTRACT

A nip formation member is configured to be disposed inside a loop of a rotatable belt. The nip formation member includes a base, a thermal equalizer, an attachment, and a fastener. The base has a bottomed fastening hole. The thermal equalizer is configured to face the belt and a surface of the base not having the bottomed fastening hole. The thermal equalizer has a higher thermal conductivity than the base. The attachment has a fastening hole and face another surface of the base having the bottomed fastening hole. The attachment is configured to fix and position the base and the thermal equalizer. The fastener is fastened to the bottomed fastening hole of the base through the fastening hole of the attachment from the attachment.

16 Claims, 9 Drawing Sheets

NIP FORMATION MEMBER, HEATING DEVICE, FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Applications No. 2019-136810, filed on Jul. 25, 2019 and No. 2020-083917, filed on May 12, 2020 in the Japan Patent Office, the entire disclosure of which are hereby incorporated by reference herein.

BACKGROUND

Technical Field

Embodiments of the present disclosure relate to a nip formation member, a heating device incorporating the nip formation member, a fixing device incorporating the heating device, and an image forming apparatus incorporating the fixing device.

Background Art

A fixing device including a belt such as a fixing belt includes a nip formation member that contacts an inner circumferential surface of the fixing belt to form a fixing nip between the fixing belt and an opposed rotator such as a pressure roller.

One type of nip formation member to form the nip as described above includes a plurality of members. For example, such a nip formation member includes a base plate and a high thermal conduction member facing the fixing belt and having a thermal conductivity greater than a thermal conductivity of the base plate. In the above-described nip formation member configured by a plurality of members, for example, the base plate and the high thermal conduction member are fixed and positioned via another attachment to accurately position the base plate and the high thermal conduction member.

SUMMARY

This specification describes an improved nip formation member configured to be disposed inside a loop of a rotatable belt. The nip formation member includes a base, a thermal equalizer, an attachment, and a fastener. The base has a bottomed fastening hole. The thermal equalizer is configured to face the belt and a surface of the base not having the bottomed fastening hole. The thermal equalizer has a higher thermal conductivity than the base. The attachment has a fastening hole and face another surface of the base having the bottomed fastening hole. The attachment is configured to fix and position the base and the thermal equalizer. The fastener is fastened to the bottomed fastening hole of the base through the fastening hole of the attachment from the attachment.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
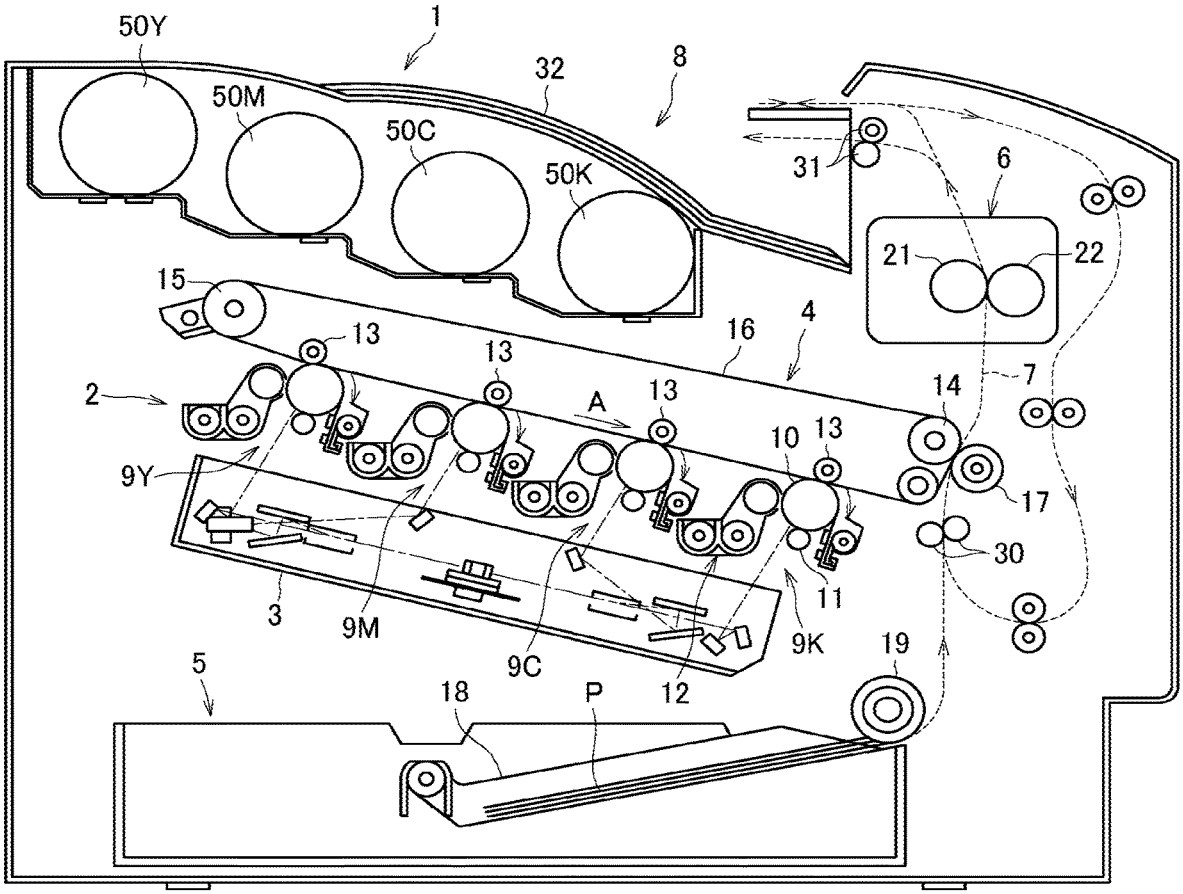
FIG. 1 is a schematic view illustrating a configuration of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring to the drawings, embodiments of the present disclosure are described below.

Identical reference numerals are assigned to identical components or equivalents and a description of those components is simplified or omitted.

The following is a description of a fixing device to fix an image onto a sheet as a recording medium, as an example of a heating device including a nip formation member, and a description of an image forming apparatus including the fixing device. However, the heating device and the fixing device are not always the same concept, and the fixing device may include a heating device as one component.

As illustrated in FIG. 1, the image forming apparatus 1 includes an image forming device 2 disposed in a center portion of the image forming apparatus 1. The image forming device 2 includes four process units 9Y, 9M, 9C, and 9K removably installed in the image forming apparatus 1. The process units 9Y, 9M, 9C, and 9K have identical configurations, except that the process units 9Y, 9M, 9C, and 9K contain developers in different colors, that is, yellow (Y), magenta (M), cyan (C), and black (K) corresponding to color-separation components of a color image.

Specifically, each of the process units 9Y, 9M, 9C, and 9K includes, e.g., a photoconductor 10, a charging roller 11, and a developing device 12. The photoconductor 10 is a drum-shaped rotator serving as an image bearer that bears toner as a developer on a surface of the photoconductor 10. The charging roller 11 uniformly charges the surface of the photoconductor 10. The developing device 12 includes a developing roller to supply toner to the surface of the photoconductor 10.

Below the process units 9Y, 9C, 9M, and 9K, an exposure device 3 is disposed. The exposure device 3 emits laser light beams based on image data.

Above the image forming device 2, a transfer device 4 is disposed. The transfer device 4 includes, e.g., a drive roller 14, a driven roller 15, an intermediate transfer belt 16, and four primary transfer rollers 13. The intermediate transfer belt 16 is an endless belt rotatably stretched around the drive roller 14, the driven roller 15, and the like. Each of the four primary transfer rollers 13 is disposed opposite the corresponding photoconductor 10 in each of the process units 9Y, 9C, 9M, and 9K via the intermediate transfer belt 16. At the position opposite the corresponding photoconductor 10, each of the four primary transfer rollers 13 presses an inner circumferential surface of the intermediate transfer belt 16 against the corresponding photoconductor 10 to form a primary transfer nip between a pressed portion of the intermediate transfer belt 16 and the photoconductor 10.

A secondary transfer roller 17 is disposed opposite the drive roller 14 via the intermediate transfer belt 16. The secondary transfer roller 17 is pressed against an outer circumferential surface of the intermediate transfer belt 16 to form a secondary transfer nip between the secondary transfer roller 17 and the intermediate transfer belt 16. The drive roller 14, the intermediate transfer belt 16, and the secondary transfer roller 17 function as an image transferor to transfer an image onto a sheet P as a recording medium.

A sheet feeder 5 is disposed in a lower portion of the image forming apparatus 1. The sheet feeder 5 includes a sheet tray 18, which contains sheets P as recording media, and a sheet feeding roller 19 to feed the sheets P from the sheet tray 18.

The sheets P are conveyed along a conveyance path 7 from the sheet feeder 5 toward a sheet ejector 8. Conveyance roller pairs including a registration roller pair 30 are disposed along the conveyance path 7.

The fixing device 6 as the heating device includes a fixing belt 21 heated by a heater, a pressure roller 22 that presses against the fixing belt 21, and the like.

The sheet ejector 8 is disposed in an extreme downstream part of the conveyance path 7 in a direction of conveyance of the sheet P (hereinafter referred to as a sheet conveyance direction) in the image forming apparatus 1. The sheet ejector 8 includes a sheet ejection roller pair 31 and an output tray 32. The sheet ejection roller pair 31 ejects the sheets P onto the output tray 32 disposed atop a housing of the image forming apparatus 1. Thus, the sheets P lie stacked on the output tray 32.

In an upper portion of the image forming apparatus 1, removable toner bottles 50Y, 50C, 50M, and 50K are disposed. The toner bottles 50Y, 50C, 50M, and 50K are filled with fresh toner of yellow, cyan, magenta, and black, respectively. A toner supply tube is interposed between each of the toner bottles 50Y, 50C, 50M, and 50K and the corresponding developing device 12. The fresh toner is supplied from each of the toner bottles 50Y, 50C, 50M, and 50K to the corresponding developing device 12 through the toner supply tube.

Next, a description is given of a basic operation of the image forming apparatus 1 with reference to FIG. 1.

As the image forming apparatus 1 receives a print job and starts an image forming operation, the exposure device 3 emits laser light beams onto the outer circumferential surfaces of the photoconductors 10 of the process units 9Y, 9M, 9C, and 9K according to image data, thus forming electrostatic latent images on the photoconductors 10. The image data used to expose the respective photoconductors 10 by the exposure device 3 is monochrome image data produced by decomposing a desired full color image into yellow, magenta, cyan, and black image data. After the exposure device 3 forms the electrostatic latent images on the photoconductors 10, the drum-shaped developing rollers of the developing devices 12 supply yellow, magenta, cyan, and black toners stored in the developing devices 12 to the electrostatic latent images, rendering visible the electrostatic latent images as developed visible images, that is, yellow, magenta, cyan, and black toner images, respectively.

In the transfer device 4, the intermediate transfer belt 16 moves along with rotation of the drive roller 14 in a direction indicated by arrow A in FIG. 1. A power supply applies a constant voltage or a constant current control voltage having a polarity opposite a polarity of the toner to each primary transfer roller 13. As a result, a transfer electric field is formed at the primary transfer nip. The yellow, magenta, cyan, and black toner images are primarily transferred from the photoconductors 10 onto the intermediate transfer belt 16 successively at the primary transfer nips such that the yellow, magenta, cyan, and black toner images are superimposed on a same position on the intermediate transfer belt 16.

On the other hand, as the image forming operation starts, the sheet feeding roller 19 of the sheet feeder 5 disposed in the lower portion of the image forming apparatus 1 is driven and rotated to feed the sheet P from the sheet tray 18 toward the registration roller pair 30 through the conveyance path 7. The registration roller pair 30 conveys the sheet P fed to the conveyance path 7 by the sheet feeding roller 19 to the secondary transfer nip formed between the secondary transfer roller 17 and the intermediate transfer belt 16 supported by the drive roller 14, timed to coincide with the superimposed toner image on the intermediate transfer belt 16. At this time, a transfer voltage having a polarity opposite the toner charge polarity of the toner image formed on the surface of the intermediate transfer belt 16 is applied to the sheet P, and the transfer electric field is generated in the secondary transfer nip. Due to the transfer electric field generated in the secondary transfer nip, the toner images formed on the intermediate transfer belt 16 are collectively transferred onto the sheet P.

The sheet P bearing the full color toner image is conveyed to the fixing device 6 where the fixing belt 21 and the pressure roller 22 fix the full color toner image onto the sheet P under heat and pressure. The sheet P having the fixed toner image thereon is separated from the fixing belt 21 and conveyed by the conveyance roller pair to the sheet ejector 8. The sheet ejection roller pair 31 of the sheet ejector 8 ejects the sheet P onto the output tray 32.

The above description is of the image forming operation of the image forming apparatus 1 to form the full color toner image on the sheet P. Alternatively, the image forming apparatus 1 may form a monochrome toner image by using any one of the four process units 9Y, 9M, 9C, and 9K, or may form a bicolor toner image or a tricolor toner image by using two or three of the process units 9Y, 9M, 9C, and 9K.

Figure 2:
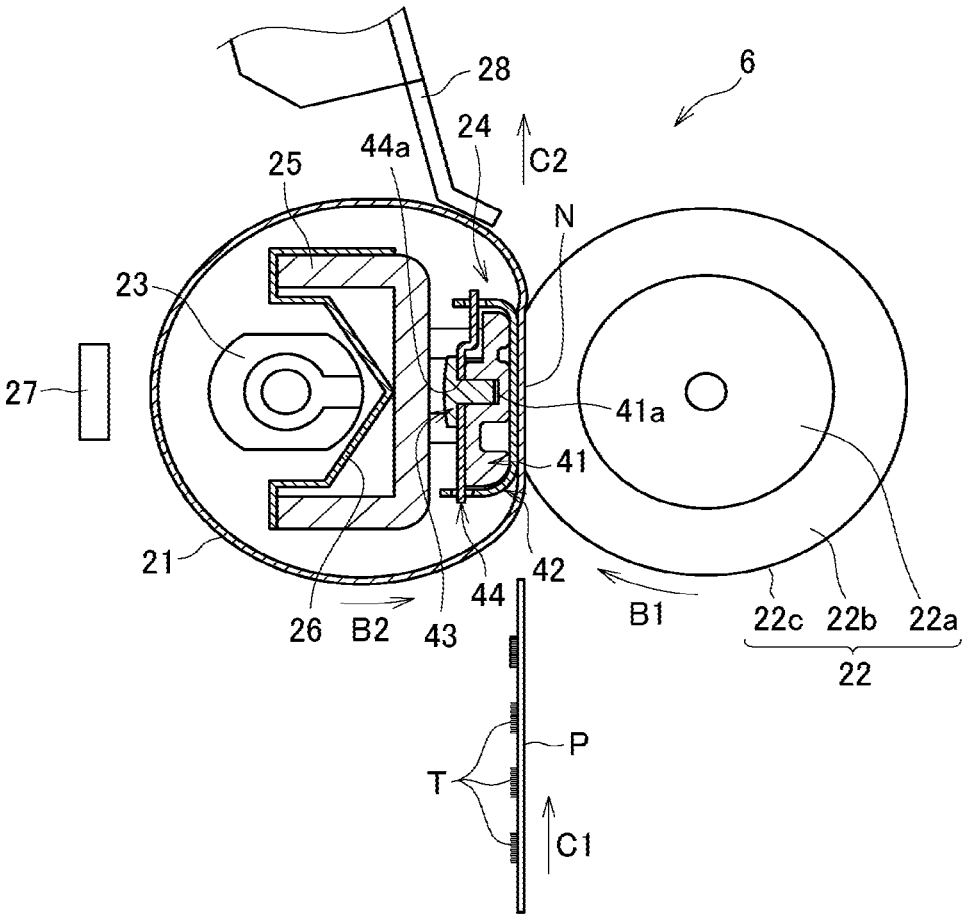
FIG. 2 is a cross-sectional view of a fixing device according to an embodiment of the present disclosure.

With reference to FIG. 2, a detailed description is provided of a basic configuration of the fixing device 6.

As illustrated in FIG. 2, the fixing device 6 includes a fixing belt 21 as a rotatable belt or a fixing member, a pressure roller 22 as an opposed rotator rotatably disposed opposite the fixing belt 21, a halogen heater 23 as a heater to heat the fixing belt 21, a nip formation member 24 disposed inside a loop of the fixing belt 21, a stay 25 as a support to contact a back face of the nip formation member 24 and support the nip formation member 24, a reflector 26 to reflect light radiated from the halogen heater 23 toward the fixing belt 21, a temperature sensor 27 as a temperature detector to detect the temperature of the fixing belt 21, a separator 28 to separate the sheet from the fixing belt 21, and a biasing mechanism that presses the pressure roller 22 against the fixing belt 21.

The fixing belt 21 is a thin, flexible, endless belt member (which may be a film). The fixing belt 21 is constructed of a base layer to form the inner circumferential surface of the fixing belt 21 and a release layer to form the outer circumferential surface of the fixing belt 21. The base layer is made of metal such as nickel or stainless steel (Stainless Used Steel, SUS). Alternatively, the base layer may be made of resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer. The elastic layer absorbs the slight surface roughness in the fixing belt 21, thereby reducing formation of the faulty orange-peel image.

The pressure roller 22 includes a cored bar 22*a*; an elastic layer 22*b* disposed on the surface of the cored bar 22*a*, which is made of foamed silicone rubber, silicon rubber, or the fluoro-rubber; and a release layer 22*c* disposed on the surface of the elastic layer 22*b*, which is made of PFA or PTFE. The biasing mechanism presses the pressure roller 22 against the nip formation member 24 via the fixing belt 21. At a portion at which the pressure roller 22 contacts and presses the fixing belt 21, deformation of the elastic layer 22*b* of the pressure roller 22 forms the fixing nip N having a predetermined width in a sheet conveyance direction. A driver such as a motor situated inside the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22.

According to the present embodiment, the pressure roller 22 is a solid roller. Alternatively, the pressure roller 22 may be a hollow roller. In a case in which the pressure roller 22 is a hollow roller, a heat source such as a halogen heater may be disposed inside the pressure roller 22. If the pressure roller 22 does not include the elastic layer 22*b*, the pressure roller 22 has a decreased thermal capacity and can be heated quickly to a predetermined fixing temperature at which a toner image T is fixed on the sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, preferably, the pressure roller 22 includes the elastic layer not thinner than 100 μm. The elastic layer not thinner than 100 μm elastically deforms to absorb the slight surface asperities in the fixing belt 21, thus preventing uneven gloss of the toner image on the sheet P. The elastic layer 22*b* may be made of solid rubber. Alternatively, if no heater is situated inside the pressure roller 22, the elastic layer 22*b* may be made of sponge rubber. The sponge rubber is preferable to the solid rubber because the sponge rubber has enhanced thermal insulation and so draws less heat from the fixing belt 21. According to this embodiment, the pressure roller 22 is pressed against the fixing belt 21. Alternatively, the fixing rotator may merely contact the opposed rotator with no pressure therebetween.

Both ends of the halogen heater 23 are fixed to side plates of the fixing device 6. A power supply situated inside the image forming apparatus 1 supplies power to the halogen heater 23 so that the halogen heater 23 generates heat. A controller operatively connected to the halogen heater 23 and the temperature sensor 27 controls the halogen heater 23 based on the temperature of the outer circumferential surface of the fixing belt 21, which is detected by the temperature sensor 27. Such heating control of the halogen heater 23 adjusts the temperature of the fixing belt 21 to a desired fixing temperature. As a heater to heat the fixing belt 21, an induction heater (IH), a resistive heat generator, a carbon heater, or the like may be employed instead of the halogen heater 23.

The nip formation member 24 is in contact with an inner circumferential surface of the fixing belt 21 and extends in a width direction of the fixing belt 21 or an axial direction of the pressure roller 22 which is a direction perpendicular to a sheet surface of FIG. 2 and hereinafter referred to as a longitudinal direction of the nip formation member 24. The nip formation member 24 supports the inner circumferential surface of the fixing belt 21 that receives the pressing force from the pressure roller 22 and forms the fixing nip N between the pressure roller 22 and the fixing belt 21.

A back surface of the nip formation member 24 is secured to and supported by the stay 25. Accordingly, even if the nip formation member 24 is pressed by the pressure roller 22, the stay 25 prevents the nip formation member 24 from being bent by the pressure of the pressure roller 22 and therefore allows the nip formation member 24 to maintain a uniform nip length of the fixing nip N over the entire width of the pressure roller 22 in an axial direction of the pressure roller 22. A detailed description of a configuration of the nip formation member 24 is deferred.

The stay 25 extends in the longitudinal direction of the nip formation member 24. The stay 25 contacts the back surface of the nip formation member 24 over the longitudinal direction of the nip formation member 24 to support the nip formation member 24 against the pressure from the pressure roller 22. Preferably, the stay 25 is made of metal having an increased mechanical strength, such as stainless steel and iron, to prevent bending of the nip formation member 24. Alternatively, the stay 25 may be made of resin.

When the stay 25 supports the nip formation member 24, a surface of the nip formation member 24 opposite the pressure roller 22 that is a left surface of the nip formation member in FIG. 2 contacts the stay 25 having a portion extending in the pressing direction of the pressure roller 22 (the lateral direction in FIG. 2) or a certain thick portion. Such a configuration reduces a bend of the nip formation member 24 caused by the pressing force from the pressure roller 22, in particular, the bend in the longitudinal direction of the nip formation member 24 in the present embodiment. However, the above-described contact includes not only the case where the stay 25 is in direct contact with the nip formation member 24 but also the case where the stay 25 contacts the nip formation member 24 via another member as in the present embodiment. The term "contact via another member" means a state in which another member is interposed between the stay 25 and the nip formation member 24 in the lateral direction in FIG .2 and at a position corresponding to at least a part of the member, the stay 25 contacts the member, and the member contacts the nip formation member 24. The term "extending in the pressing direction" is not limited to a case where the portion of the stay 25 extends in the same direction as the pressing direction of the pressure roller 22, but includes the case where the portion of the stay 25 extends in a direction with a certain angle from the pressing direction of the pressure roller 22. Even in such cases, the stay 25 can reduce bending of the nip formation member 24 under pressure from the pressure roller 22.

The reflector 26 is interposed between the stay 25 and the halogen heater 23. In the present embodiment, the reflector 26 is secured to the stay 25. The reflector 26 is made of aluminum, stainless steel, or the like. The reflector 26 thus disposed reflects, to the fixing belt 21, the light radiated from the halogen heater 23 toward the stay 25. Such reflection by the reflector 26 increases an amount of light that irradiates the fixing belt 21, thereby heating the fixing belt 21 efficiently. In addition, the reflector 26 prevents transmitting radiant heat from the halogen heater 23 to the stay 25 and the like, thus saving energy.

Alternatively, instead of installation of the reflector 26, an opposed face of the stay 25 disposed opposite the halogen heater 23 may be treated with polishing or mirror finishing such as coating to produce a reflection face that reflects light from the halogen heater 23 toward the fixing belt 21. Preferably, the reflector 26 or the reflection face of the stay 25 has a reflectance of 90% or more.

Since the shape and the material of the stay 25 are limited to those that provide good mechanical strength, if the reflector 26 is installed in the fixing device 6 separately from the stay 25, the reflector 26 and the stay 25 provide flexibility in the shape and the material, attaining properties peculiar to them, respectively. The reflector 26 interposed between the halogen heater 23 and the stay 25 is situated in proximity to the halogen heater 23, reflecting light from the halogen heater 23 toward the fixing belt 21 to heat the fixing belt 21 effectively.

In order to further enhance the efficiency of heating the fixing belt 21 by light reflection, the direction of the reflector 26 or the reflection face of the stay 25 is to be considered. For example, when the reflector 26 is disposed concentrically with the halogen heater 23 as the center, the reflector 26 reflects light toward the halogen heater 23, resulting in a decrease in heating efficiency. By contrast, when a part or all of the reflector 26 is disposed in a direction to reflect light toward the fixing belt 21, not a direction to reflect light toward the halogen heater 23, the reflector 26 reflects less light toward the halogen heater 23, thereby enhancing the efficiency of heating the fixing belt 21 by the reflected light.

A description is now given of various structural advantages of the fixing device 6 to enhance energy saving and shorten a first print time taken to output the sheet P bearing the fixed toner image upon receipt of a print job through preparation for a print operation and the subsequent print operation.

For example, the fixing device 6 employs a direct heating method in which the halogen heater 23 directly heats the fixing belt 21 in a circumferential direct heating span on the fixing belt 21 other than the fixing nip N. According to the present embodiment, no component is interposed between a left side of the halogen heater 23 and the fixing belt 21 in FIG. 2 such that the halogen heater 23 radiates heat directly to the circumferential direct heating span on the fixing belt 21.

In order to decrease the thermal capacity of the fixing belt 21, the fixing belt 21 is thin and has a decreased loop diameter. For example, the base layer of the fixing belt 21 is designed to have a thickness of from 20 μm to 50 μm, the elastic layer is designed to have a thickness of from 100 μm to 300 μm, and the release layer is designed to have a thickness of from 10 μm to 50 μm. Thus, the fixing belt 21 is designed to have a total thickness not greater than 1 mm. The loop diameter of the fixing belt 21 is set in a range of from 20 mm to 40 mm. In order to further decrease the thermal capacity of the fixing belt 21, preferably, the fixing belt 21 may have the total thickness not greater than 0.20 mm and more preferably not greater than 0.16 mm. Preferably, the loop diameter of the fixing belt 21 may not be greater than 30 mm.

According to the present embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P as the recording medium from the fixing belt 21 when the sheet P is ejected from the fixing nip N.

With continued reference to FIG. 2, a description is now given of a fixing operation of the fixing device 6 according to the present embodiment.

As the image forming apparatus 1 illustrated in FIG. 1 is powered on, the halogen heater 23 is supplied with power; and the driver starts driving and rotating the pressure roller 22 in a clockwise direction of rotation indicated by arrow B1 as illustrated in FIG. 2. The rotation of the pressure roller 22 drives the fixing belt 21 to rotate in a counterclockwise direction of rotation indicated by arrow B2 as illustrated in FIG. 2 by friction between the fixing belt 21 and the pressure roller 22.

Thereafter, the sheet P bearing the unfixed toner image T formed in the image forming processes described above is conveyed in the sheet conveyance direction C1 in FIG. 2 while guided by a guide plate and enters the fixing nip N formed between the fixing belt 21 and the pressure roller 22 pressed against the fixing belt 21. The toner image T is fixed onto the sheet P under heat from the fixing belt 21 heated by the halogen heater 23 and pressure exerted between the fixing belt 21 and the pressure roller 22.

The sheet P bearing the fixed toner image T is sent out from the fixing nip N and conveyed in a direction C2 as illustrated in FIG. 2. As a leading edge of the sheet P contacts a front edge of the separator 28, the separator 28 separates the sheet P from the fixing belt 21. The sheet P separated from the fixing belt 21 is ejected by the sheet ejection roller pair 31 depicted in FIG. 1 onto the outside of the image forming apparatus 1, that is, the output tray 32 that stacks the sheet P.

Next, the configuration of the nip formation member 24 is described in detail.

Figure 3:
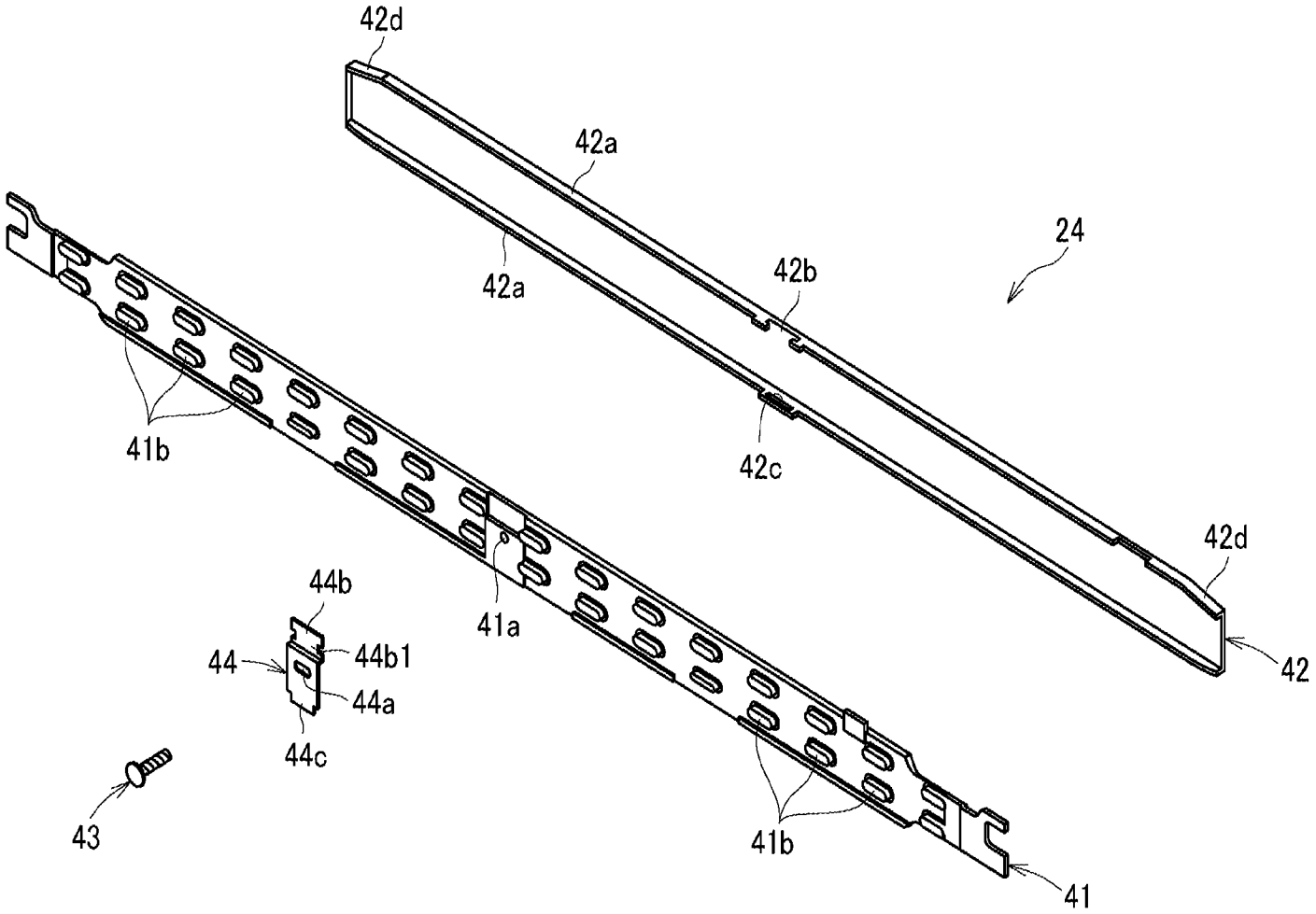
FIG. 3 is an exploded perspective view illustrating parts of a nip formation member.

As illustrated in FIGS. 2 and 3, the nip formation member 24 includes a base 41, a thermal equalizer 42 serving as a high thermal conduction member, a screw 43 serving as a fastener, and an attachment 44 that fastens the screw 43. The base 41 and the thermal equalizer 42 extend in the longitudinal direction of the nip formation member 24.

The base 41 is made of a heat-resistant material such as an inorganic substance, rubber, resin, or a combination thereof. Examples of the inorganic substance include ceramic, glass, and aluminum. Examples of the rubber include silicone rubber and fluororubber. An example of the resin is fluororesin such as polytetrafluoroethylene (PTFE), perfluoroalkoxy alkane (PFA), ethylenetetrafluoroethylene (ETFE), and tetrafluoroethylene-hexafluoropropylene copolymer (FEP). Other examples of the resin include polyimide (PI), polyamide imide (PAI), polyphenylene sulfide (PPS), polyether ether ketone (PEEK), liquid crystal polymer (LCP), phenolic resin, nylon and aramid.

In the present embodiment, the base 41 is made of resin, and the thermal conductivity of the base 41 is set to, for example, about 0.2 to 0.3 W/m·K. As the resin to form the base 41, for example, a liquid crystal polymer (LCP) having excellent heat resistance and moldability may be adopted.

The base 41 has a fastening hole 41*a* in a longitudinal center portion of the base 41. The screw 43 is inserted into the fastening hole 41*a* to fasten the base 41 and the attachment 44. The fastening hole 41*a* is not a through-hole and has a depth smaller than a thickness of the base 41 in a thickness direction of the base 41.

As illustrated in FIG. 3, the base 41 includes a plurality of projections 41*b* projecting toward the stay 25. The plurality of projections 41*b* includes projections 41*b* arranged in a longitudinal direction of the base 41 in two lines in a transverse direction of the base 41. The plurality of projections 41*b* is a positioner that contacts the stay 25 and positions the nip formation member 24 relative to the stay 25.

The thermal equalizer 42 is in contact with the inner circumferential surface of the fixing belt 21 as illustrated in FIG. 2. The thermal equalizer 42 is made of a material having a thermal conductivity greater than a thermal conductivity of the base 41. Specifically, in the present embodiment, the thermal equalizer 42 is made of steel use stainless (SUS) having a thermal conductivity in a range of from 16.7 to 20.9 W/(mK). Alternatively, the thermal equalizer 42 may be made of a material having a relatively high thermal conductivity, such as a copper-based material having a thermal conductivity of, e.g., 381 W/(mK) or an aluminum-based material having a thermal conductivity of, e.g., 236 W/(mK).

Arranging the thermal equalizer 42 having a good thermal conductivity on a fixing belt side of the nip formation member 24 to contact the fixing belt 21 along the width direction of the fixing belt 21 can transmit and equalize heating of the fixing belt 21 in the width direction and thus reduce temperature unevenness of the fixing belt 21 in the width direction.

The thermal equalizer 42 has bent portions 42*a* bent from both ends in a transverse direction of the thermal equalizer 42. The bent portions 42*a* extend in a longitudinal direction of the thermal equalizer 42. As illustrated in FIG. 2, in the present embodiment, to form the bent portions 42*a* of the thermal equalizer 42, both end portions of a metal plate in the transverse direction that are an upper side and a lower side in FIG. 2 are bent toward a direction substantially perpendicular to the transverse direction, that is, the left side in FIG. 2 and an opposite direction from the fixing nip N.

As illustrated in FIG. 3, in the present embodiment, the thermal equalizer 42 has a first insertion hole 42*b* and a second insertion hole 42*c* in the respective longitudinal middles of the bent portions 42*a*, on the opposed transverse sides of the thermal equalizer 42 to attach the attachment 44 to the thermal equalizer 42. As illustrated in FIG. 3, portions having the first insertion hole 42*b* and the second insertion hole 42*c* in the bent portions 42*a* are shaped partially projecting in the direction in which the thermal equalizer 42 is bent away from the fixing nip N, beyond other portions of the bent portions 42*a*. The second insertion hole 42*c* is a through-hole penetrating the bent portion 42*a* of the thermal equalizer 42 in a transverse direction of the thermal equalizer 42 (i.e., a vertical direction in FIG. 2). The first insertion hole 42*b* penetrates the bent portion 42*a* of the thermal equalizer 42 in the transverse direction of the thermal equalizer 42, which is the same as the second insertion hole 42*c*, and opens toward one side in a thickness direction of the thermal equalizer 42.

The thermal equalizer 42 includes converging portions 42*d* on opposed longitudinal end portions of the thermal equalizer 42, respectively. The converging portions 42*d* narrow the thermal equalizer 42 in the transverse direction of the thermal equalizer 42 toward opposed longitudinal edges of the thermal equalizer 42, respectively.

The attachment 44 is a member independent from the base 41 and the thermal equalizer 42 to position the thermal equalizer 42 on the base 41. The attachment 44 has a fastening hole 44*a* in the middle of the attachment 44 to fix the screw 43. The attachment 44 has a first insertion portion 44*b* and a second insertion portion 44*c* on both end portions of the attachment 44. The first insertion portion 44*b* has a narrow portion 44*b*1 that is a narrow part of the first insertion portion 44*b* having a small width.

Next, with reference to FIGS. 4A, 4B, 5A, and 5B, a method to assemble the above members is described.

Figure 4A:
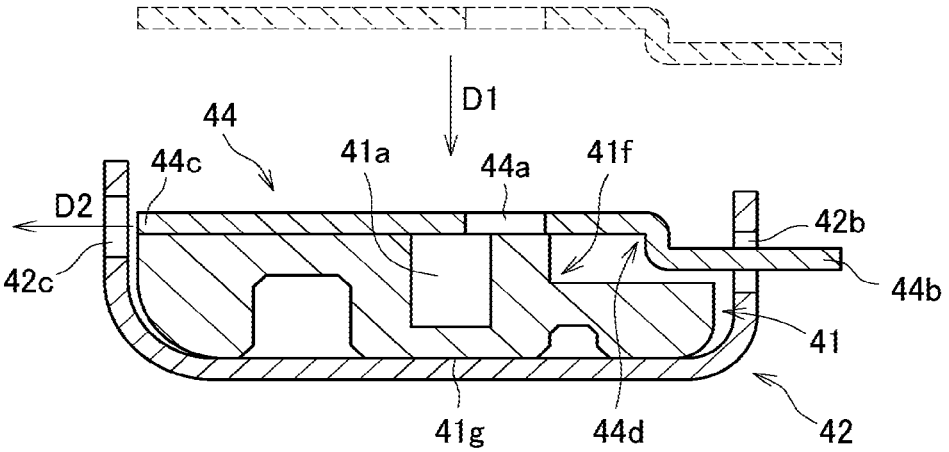
FIGS. 4A and 4B are cross-sectional views illustrating a method to attach an attachment to a thermal equalizer.
Figure 4B:
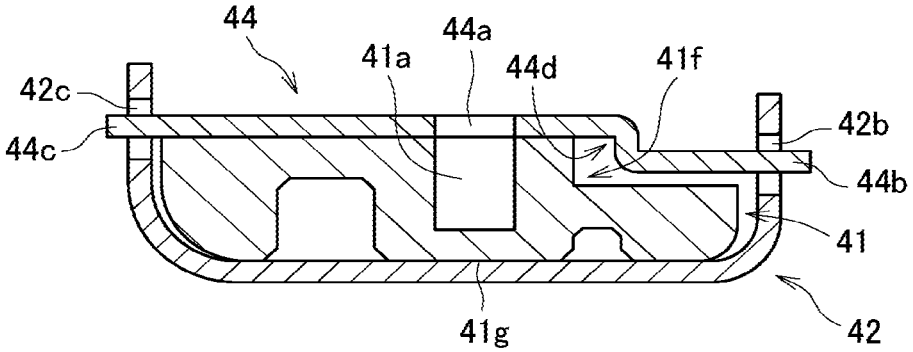
Figure 5A:
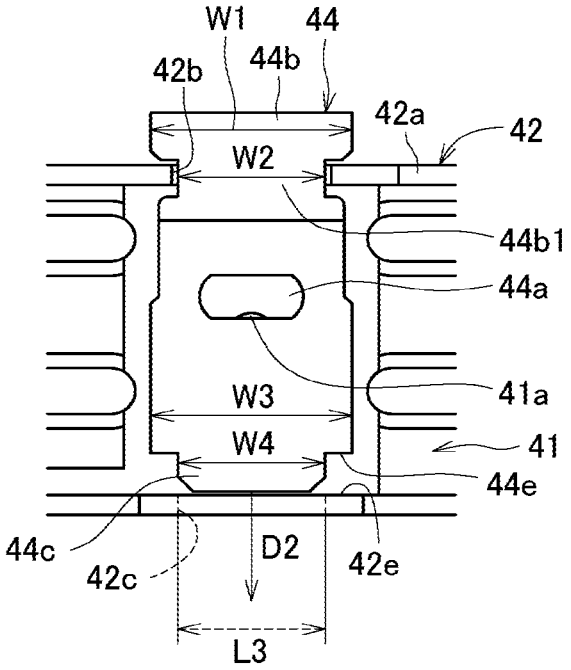
FIGS. 5A and 5B are plan views illustrating the method to attach the attachment to the thermal equalizer.
Figure 5B:
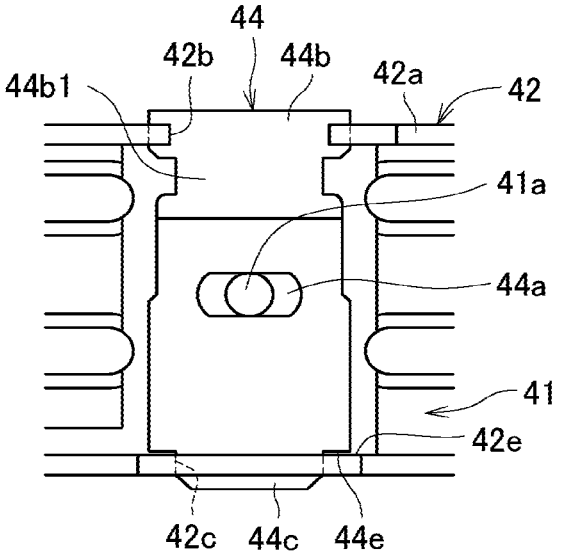

First, as illustrated in FIGS. 4A and 5A, the attachment 44 is placed on the base 41 and the thermal equalizer 42 from above the base 41 and the thermal equalizer 42 in a direction indicated by arrow D1 in FIG. 4A. Specifically, as illustrated in FIG. 5A, the narrow portion 44*b*1 of the attachment 44 is inserted into the first insertion hole 42*b* of the thermal equalizer 42. Next, the attachment 44 is slid to the side of the second insertion hole 42*c* in a direction indicated by arrow D2 in FIGS. 4A and 5A to insert the second insertion portion 44*c* of the attachment 44 into the second insertion hole 42*c* of the thermal equalizer 42. As a result, as illustrated in FIGS. 4B and 5B, the attachment 44 can be attached to the thermal equalizer 42. As described above, the narrow portion 44*b*1 that is a part of the attachment 44 and the first insertion hole 42*b* disposed on one side of the thermal equalizer 42 and opened in the thickness direction of the thermal equalizer 42 enable inserting the attachment 44 to the thermal equalizer 42 from above the thermal equalizer 42. The above-described work is easier than sliding the first insertion portion 44*b* and the second insertion portion 44*c* at both ends of the attachment 44 and inserting them into the first insertion hole 42*b* and the second insertion hole 42*c*. When the attachment 44 is inserted into the thermal equalizer 42, the attachment 44 may be caught by the thermal equalizer 42, and a pressure in a direction of the insertion may occur and deform the attachment 44 and the thermal equalizer 42. The above-described configuration can prevent such deformation.

Figure 13:
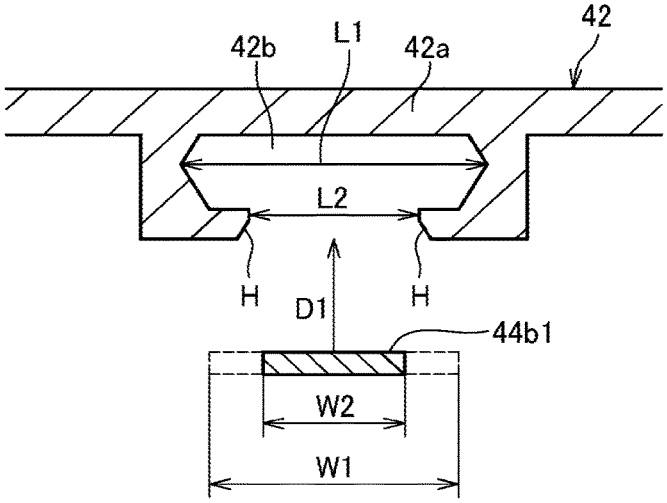
FIG. 13 is an explanatory view illustrating how an insertion portion of the attachment is inserted into an insertion hole of the thermal equalizer.

As illustrated in FIG. 5A, the first insertion portion 44*b* of the attachment 44 has a wide portion having a width W1, and the narrow portion 44*b*1 has a width W2. As illustrated in FIG. 13, the first insertion hole 42*b* of the thermal equalizer 42 has a wide portion having a width L1 and a narrow portion on the opening side having the width L2. The relation of the widths is W2<L2<W1<L1. Because of the relation W2<L2, the above-described movement of the attachment 44 toward the thermal equalizer 42 in the direction indicated by arrow D1 can insert the narrow portion 44*b* 1 into the first insertion hole 42*b* of the thermal equalizer 42. In addition, because of the relation L2<W1, a state as illustrated in FIG. 5B, that is, the state in which the wide portion of the first insertion portion 44*b* comes into contact with a wall surface forming the narrow portion of the first insertion hole 42*b* in the opening side can prevent the attachment 44 from falling off the thermal equalizer 42 in a direction perpendicular to the sheet surface of FIG. 5B that is a direction opposite to the direction indicated by arrow D1 in FIG. 13. Additionally, the first insertion hole 42*b* has a tapered shape H at an opening on the insertion side as illustrated in FIG. 13. The tapered shape H enables smoothly inserting the first insertion portion 44*b* into the first insertion hole 42*b*. However, the first insertion hole 42*b* may not have the tapered shape H.

As illustrated in FIG. 5A, a width W3 of a portion near the second insertion portion 44*c* in the attachment 44, a width W4 of the second insertion portion 44*c*, and a width L3 of the second insertion hole 42*c* of the thermal equalizer 42 has a relation W4<L3<W3. The relation W4<L3 enables inserting the second insertion portion 44*c* into the second insertion hole 42*c*. The relation L3<W3 enables a contact surface 44*e* of the attachment 44 that is a lower end face of the attachment 44, that is, the end face of the attachment 44 in a downstream direction when the attachment 44 is inserted into the thermal equalizer 42, to contact a contact target face 42*e* disposed on the bent portion 42*a*. The above-described widths W1 to W4 and L1 to L3 are measured along the longitudinal direction of the thermal equalizer 42.

Inserting the first insertion portion 44*b* and the second insertion portion 44*c* of the attachment 44 into the first insertion hole 42*b* and the second insertion hole 42*c* of the thermal equalizer 42, respectively positions the attachment 44 with respect to the thermal equalizer 42 in a lateral direction of FIG. 5B. Specifically, side faces of the first insertion portion 44*b* and side faces of the second insertion portion 44*c* contact side walls that define the first insertion hole 42*b* and the second insertion hole 42*c*, respectively, to restrict a lateral movement of the attachment 44 relative to the thermal equalizer 42 in FIG. 5B. Accordingly, the base 41 fastened to the attachment 44 is positioned relative to the thermal equalizer 42 in the longitudinal direction of the thermal equalizer 42. Inserting the second insertion portion 44*c* into the second insertion hole 42*c* and contacting a contact surface 44*e* of the attachment 44 that is a lower end face of the attachment 44, that is, the end face of the attachment 44 in the downstream direction when the attachment 44 is inserted into the thermal equalizer 42 with the contact target face 42*e* disposed on the bent portion 42*a* positions the base 41 fastened to the attachment 44 relative to the thermal equalizer 42 in a vertical direction of FIG. 5B.

The above-described work positions the attachment 44 with respect to the base 41 and can put the fastening hole 44*a* of the attachment 44 and the fastening hole 41*a* of the base 41 at the same position. That is, the work of just attaching the attachment 44 to the thermal equalizer 42 enables alignment of the fastening hole 44*a* and the fastening hole 41*a* and fastening the attachment 44 and the base 41 with the screw 43. Therefore, the work of aligning the fastening holes with each other is not required. An assembling time of the nip formation member can be shortened. Ease of assembling is improved. In addition, improvement on the positioning accuracy of the fastening hole 44*a* and the fastening hole 41*a* results in improvement on the positioning accuracy of the base 41 and the thermal equalizer 42. The improvement on the positioning accuracy of the fastening hole 44*a* and the fastening hole 41*a* can downsize the fastening hole 44*a*, minimize the attachment 44, and decrease the cost of the attachment 44.

Figure 6:
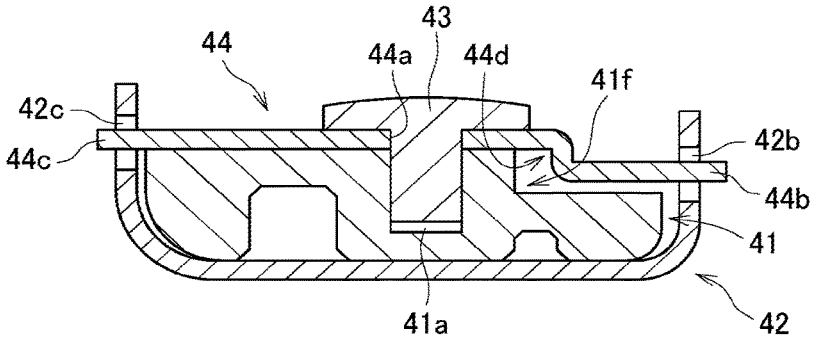
FIG. 6 is a cross-sectional view of a nip formation member.
Figure 7:
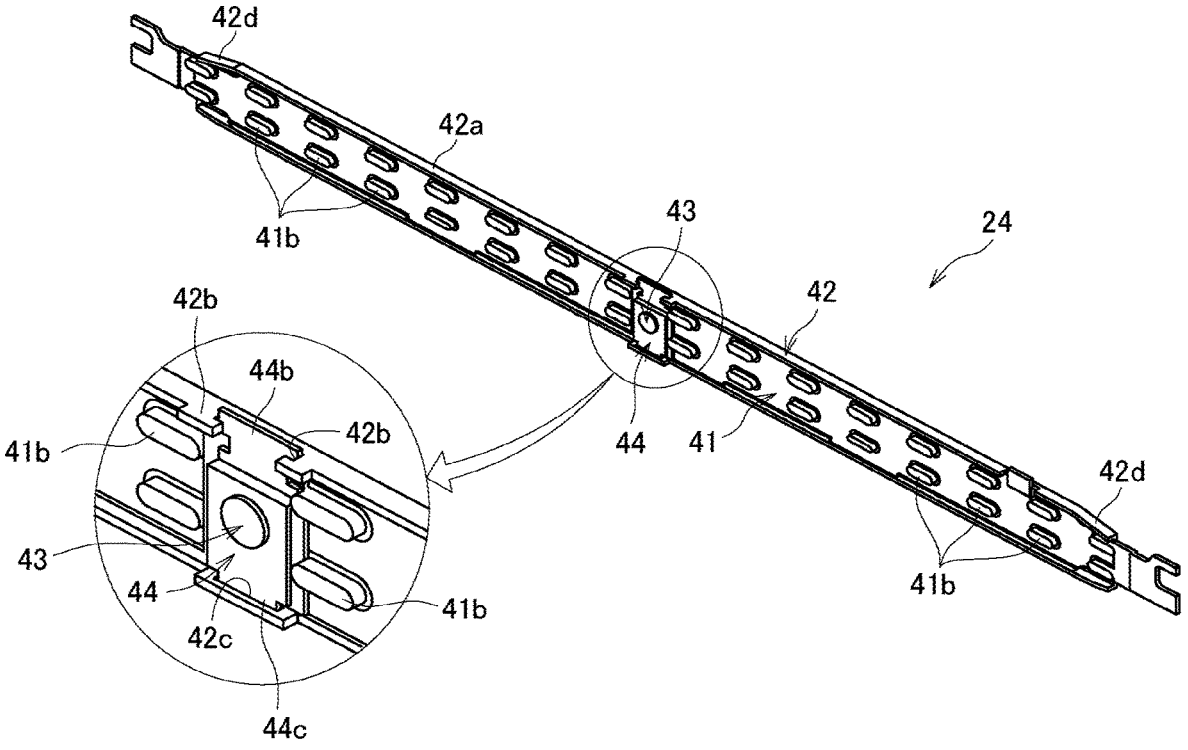
FIG. 7 is a perspective view of the nip formation member.

The fastening hole 44*a* is aligned with the fastening hole 41*a*, and the attachment 44 can be fastened on the base 41 with the screw 43 to fix the attachment 44 on the base 41. As illustrated in FIGS. 6 and 7, screwing the screw 43 in the attachment 44 and the base 41 fixes the thermal equalizer 42 on the base 41, and the nip formation member 24 is assembled.

As described above, in the present embodiment, fastening the attachment 44 to the base 41 with the screw 43 while the attachment 44 is set to the thermal equalizer 42 can position and fix the thermal equalizer 42 on the base 41 via the attachment 44. Specifically, inserting the first insertion portion 44*b* and the second insertion portion 44*c* of the attachment 44 into the first insertion hole 42*b* and the second insertion hole 42*c* of the thermal equalizer 42, respectively restricts the movement of the attachment 44 and the base 41 with respect to the thermal equalizer 42 in the longitudinal and thickness directions of the thermal equalizer 42. In addition, a transverse movement of the base 41 is restricted by the bent portions 42*a* disposed at both ends of the thermal equalizer 42 in the transverse direction of the thermal equalizer 42. The above-described configuration positions the base 41 with respect to the thermal equalizer 42.

In the present embodiment, when the first insertion portion 44*b* of the attachment 44 is inserted into the corresponding first insertion hole 42*b* of the thermal equalizer 42 at one end of the thermal equalizer 42 in the direction indicated by arrow D1 in FIG. 4A, side walls of the projections 41*b* disposed on both sides of the attachment 44 function as guides that guide a movement of the attachment 44 in a direction of the insertion, that is, the direction from one end to the other end in the transverse direction (see FIG. 5A). This guide function improves workability when the attachment 44 is inserted into the first insertion hole 42*b*. Alternatively, instead of the projections 41*b*, ribs extending from one end to the other end in the transverse direction of the base 41 may be provided as guides at the positions corresponding to the projections 41*b*.

The above-described parts related to positioning are subjected to loads caused by slide of the fixing belt 21 that rotates and slides on the nip formation member 24. However, in the present embodiment, the screw 43 fastens the attachment 44 as another member to the base 41. Such a configuration is mechanically advantageous compared with a case in which a base and a thermal equalizer are structurally secured to each other by, e.g., engagement with each other with claws.

The fastening hole 41*a* of the base 41 is a hole in the thickness direction of the base 41 and does not penetrate to the surface contacting the thermal equalizer 42. Therefore, the base 41 is in contact with the thermal equalizer 42 along the longitudinal direction of the nip formation member 24, even on a position at which the screw 43 fastens the attachment 44 to the base 41. No gap is formed between the thermal equalizer 42 and the base 41. Specifically, a contact surface 41*g* that is a surface corresponding to the fastening hole 41*a* of the base 41 is in contact with the thermal equalizer 42 (see FIGS. 4A and 4B).

Figure 8:
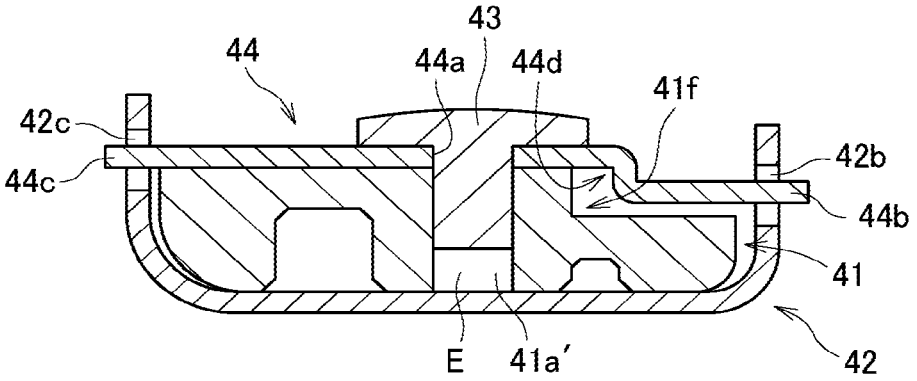
FIG. 8 is a cross-sectional view of a nip formation member having a configuration different from that in FIG. 6.
Figure 9:
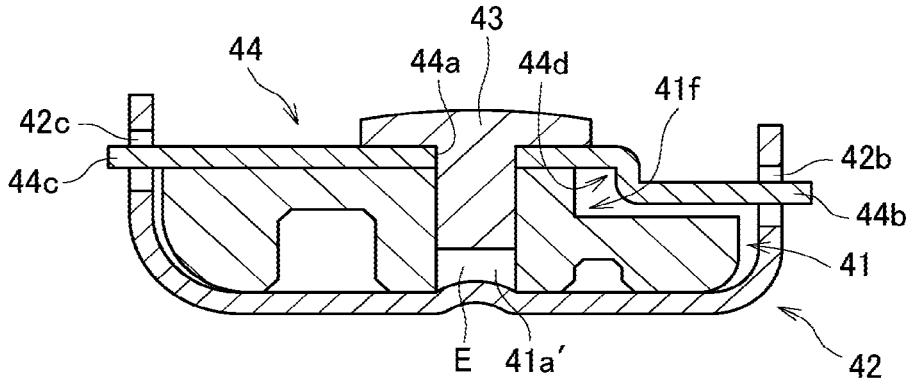
FIG. 9 is a cross-sectional view of the nip formation member of FIG. 8 including the thermal equalizer deformed.

The following is a description of an example of a configuration different from the configuration of the present embodiment. As illustrated in FIG. 8, the base 41 has a through-hole as a fastening hole 41*a'* that forms a gap E between the screw 43 and the thermal equalizer 42. That is, at a position facing the fastening hole 41*a*', the surface of the thermal equalizer 42 is not in contact with the base 41 and the screw 43, and heat does not transfer between these components. Therefore, a temperature of the thermal equalizer 42 at the position is higher than temperatures of the thermal equalizer 42 at other positions, which causes ununiform fixing belt temperature distribution in the width direction. A thermal expansion at a high temperature part of the thermal equalizer 42 becomes different. As illustrated in FIG. 9, a portion facing the fastening hole 41*a'* in the thermal equalizer 42 deforms toward the gap E. A deformation generated as described above weakens a pressure at a part of the nip N, causes an image fixing failure due to insufficient pressure, increases sliding load between the fixing belt and the nip formation member 24 at the deforming portion, and accelerates the wear of the fixing belt.

To solve the above problem, in the present embodiment, the fastening hole 41*a* is designed as a non-penetrating hole, that is, a hole not penetrating the base 41. The non-penetrating hole prevents the thermal equalizer 42 from partially increasing in temperature and deforming. As a result, the image fixing failure and the acceleration of the wear of the fixing belt can be prevented.

Figure 14:
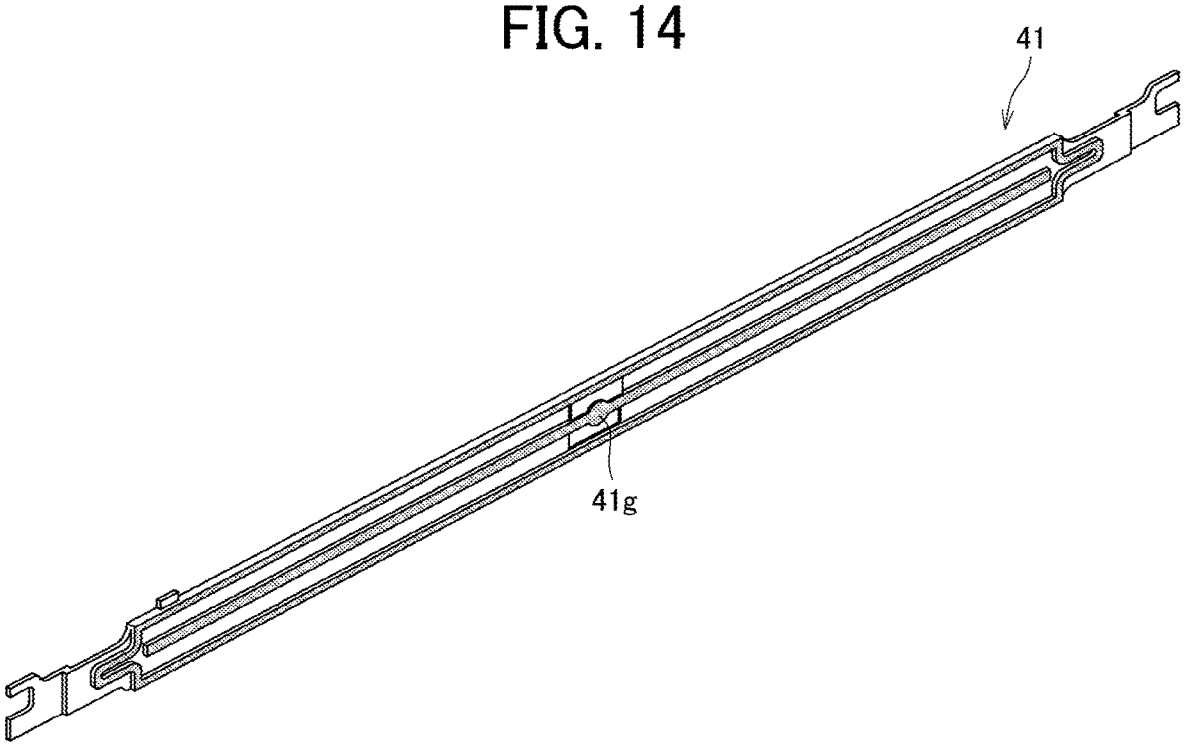
FIG. 14 is a perspective view of the base seen from a back side.

FIG. 14 is a perspective view of the base 41 seen from the back side of the base 41. As illustrated in FIG. 14, the base 41 is in contact with the thermal equalizer 42 at a hatching portion in FIG. 14. That is, the base 41 is in contact with the thermal equalizer 42 over the longitudinal direction. In the transverse direction, the base 41 is in contact with three portions, that is, both end portions and the central portion and is not in contact with the thermal equalizer 42 at a concave portion between the both end portions and the central portion. Since the base 41 continuously contacts the thermal equalizer 42 in the longitudinal direction, the base 41 and the stay 25 that contacts the base 41 can uniformly receive, over the longitudinal direction, the pressing force that the thermal equalizer 42 receives from the pressure roller 22 via the fixing belt 21 (see FIG. 2). In addition, as illustrated in FIG. 4A, the contact surface 41*g* of the base 41 is in contact with the thermal equalizer 42 at a portion corresponding to the fastening hole 41*a* of the base 41. In other words, the contact surface 41*g* of the base 41 is in contact with the thermal equalizer 42 at the portion that overlaps the fastening hole 41*a* when the base 41 is viewed from the thickness direction of the base 41. Consequently, as illustrated in FIG. 14, the above-described configuration can provide a continuous contact portion of the base 41 in the longitudinal direction that contacts the thermal equalizer 42. The fastening hole 41*a* disposed at a portion in the transverse direction at which the base 41 is not in contact with the thermal equalizer 42 over the length of the base 41 may be a through-hole.

Figure 10:
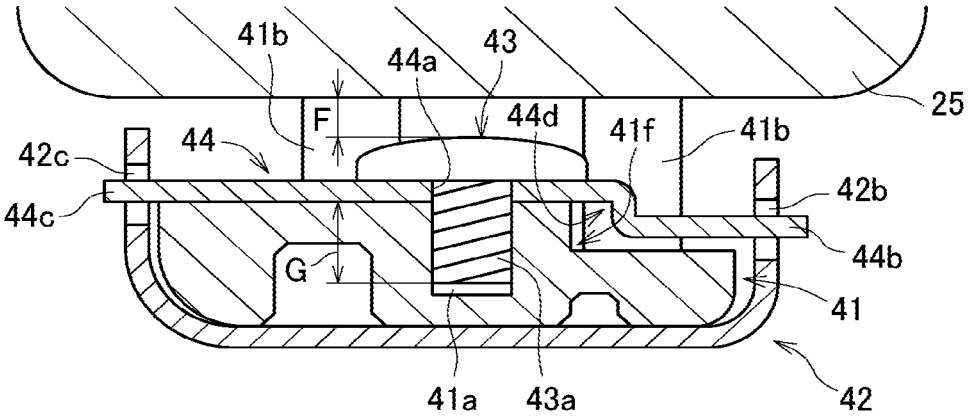
FIG. 10 is an explanatory view illustrating a positional relationship between a screw and a stay.

As illustrated in FIG. 10, in the nip formation member 24 of the present embodiment, the stay 25 contacts the projections 41*b* of the base 41 to support the back of the nip formation member 24. In the above-described configuration, there is a gap having a distance F between the stay 25 and the screw 43 in the vertical direction in FIG. 10 that is the thickness direction of the base 41 or the like and a direction in which the screw 43 is inserted into the attachment 44 and the base 41. Setting the gap as described above enables the screw 43 heated to expand in the gap and can prevent the expanded screw 43 from pushing the base 41. Pushing the base 41 may deform the nip N and cause a breakage of the nip formation member 24 due to plastic deformation of the nip formation member 24. In addition, setting the distance F of the gap smaller than a length G of a thread portion 43*a* (a fastening portion 43*a*) of the screw 43 causes the head of screw 43 to contact the stay 25 when the fastening of the screw 43 is loosed and prevents the screw 43 from falling off the base 41 and the attachment 44. In the present embodiment, the distance F of the gap between the stay 25 and the screw 43 is defined as described above. However, when another member is interposed between the stay 25 and the screw 43, the distance between the screw 43 and the other member may be defined as described above. For example, in a configuration including an attachment to attach the nip formation member 24 and the projections 41*b* of the base 41 inserted between the stay 25 and the nip formation member 24, setting a gap between the attachment and the screw 43 or setting the distance F of the gap smaller than the length G of the thread portion 43*a* can give the above effect. In FIG. 10, for the sake of convenience, the screw 43 is not drawn as a formal sectional view to distinguish the thread portion 43*a* from other parts of the screw 43.

Figure 11:
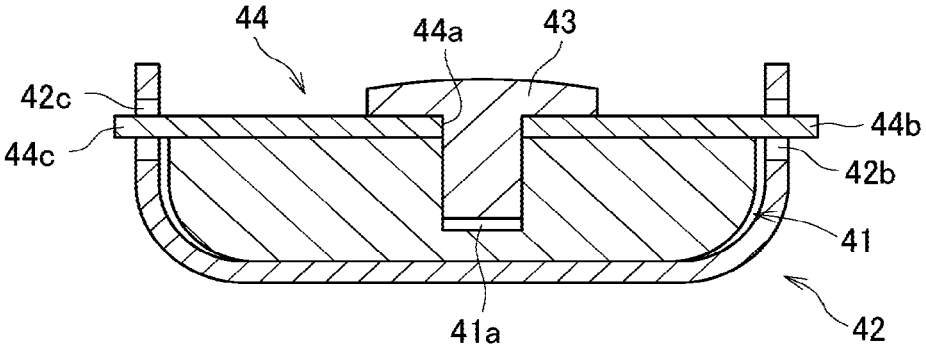
FIG. 11 is a cross-sectional view illustrating the nip formation member according to another embodiment.

In the present embodiment, as illustrated in FIG. 4B, the base 41 has a step portion 41*f* on a side opposite the attachment 44. Similarly, the attachment 44 has a step portion 44*d* on a side opposite the base 41. The step portions 41*f* and 44*d* are shaped corresponding to each other. In other words, the attachment 44 and the base 41 have steps (i.e., step portions 44*d* and 41*f*) shaped corresponding to each other. Specifically, each of the attachment 44 and the base 41 has a surface lower than a reference surface on which the attachment 44 is in contact with the base 41 in a vertical direction in FIG. 4B, more specifically, a surface lowered toward the thermal equalizer 42 in the thickness direction of the base 41. As a result, just fitting both step portions 41*f* and 44*d* can position the fastening hole 41*a* and the fastening hole 44*a*. The above improves ease of assembling the nip formation member 24 and prevents the screw 43 from being fastened in a tilted state. In addition, the attachment 44 is shaped with asymmetrical front and rear sides in the transverse direction of the attachment 44. Such a shape of the attachment 44 prevents the attachment 44 from being attached incorrectly, e.g., upside down and inside out. However, as illustrated in FIG. 11, the attachment 44 may be a plate-shaped member having no step portion.

In addition, as illustrated in FIG. 7, the attachment 44 is attached and secured by the screw 43 to the respective longitudinal middles of the base 41 and the thermal equalizer 42, thus positioning the base 41 and the thermal equalizer 42 relative to the longitudinal middle of each other. Accordingly, the base 41 and the thermal equalizer 42 are less likely to be shifted to one side in the respective longitudinal directions of the base 41 and the thermal equalizer 42. Such a configuration eliminates the axial temperature unevenness of the fixing belt 21 and the pressure deviation at the fixing nip N in the axial direction of the fixing belt 21. Note that each of the longitudinal center portion of the base 41 and the thermal equalizer 42 corresponds to a center area of three longitudinal areas into which each of the base 41 and the thermal equalizer 42 is divided. Most preferably, the respective longitudinal centers of the base 41 and the thermal equalizer 42 are secured to each other.

In the present embodiment, the base 41 is made of resin; whereas the thermal equalizer 42 is made of metal. In other words, the base 41 and the thermal equalizer 42 are made of different materials having different coefficients of thermal expansion from each other. Specifically, the base 41 and the thermal equalizer 42 exhibit different coefficients of thermal expansion caused by the heat from the halogen heater 23. Since respective longitudinal center points of the base 41 and the thermal equalizer 42 are secured to each other, the base 41 and the thermal equalizer 42 release the expanded amounts to opposed longitudinal sides of the base 41 and the thermal equalizer 42, respectively, thus preventing damage to the thermal equalizer 42 in particular.

The present disclosure is not limited to the embodiments described above, and various modifications and improvements are possible without departing from the gist of the present disclosure.

Figure 12:
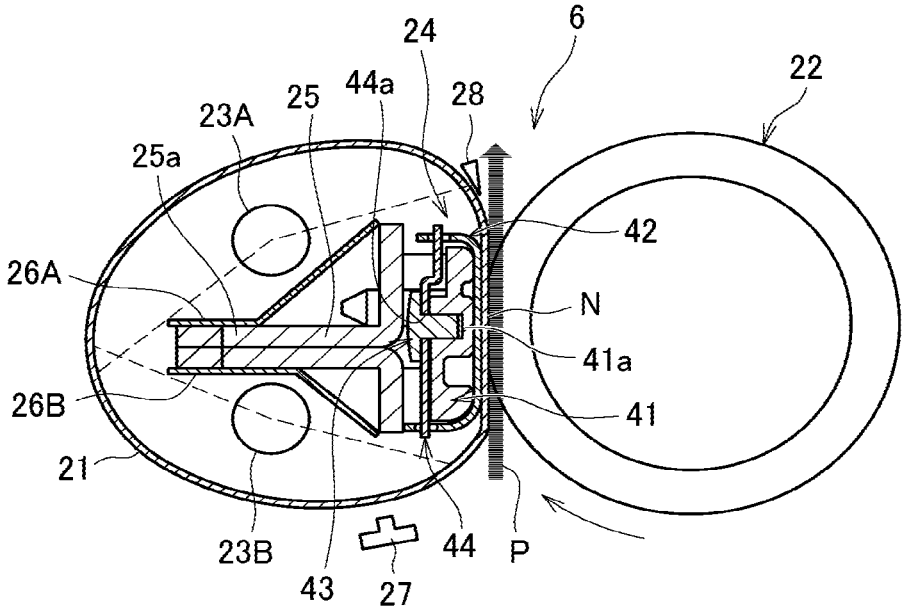
FIG. 12 is a cross-sectional view illustrating a fixing device according to another embodiment.

For example, the nip formation member according to the embodiment described above is also applicable to a fixing device 6 including a plurality of heaters as illustrated in FIG. 12. Referring now to FIG. 12, a description is given of the fixing device 6 according to another embodiment of the present disclosure, focusing on the differences between the fixing device illustrated in FIG. 2 and the fixing device illustrated in FIG. 12. Redundant descriptions of identical configurations are omitted unless otherwise required.

Similar to the fixing device in the above embodiments, the fixing device 6 includes the fixing belt 21 as the belt, the pressure roller 22, and the nip formation member 24 as illustrated in FIG. 12. In addition, the fixing device 6 of the present embodiment includes two heaters 23A and 23B. One of the heaters 23A and 23B includes a center heat generation area spanning a center of the one of the heaters 23A and 23B in the longitudinal direction thereof to heat toner images on small sheets P passing through the fixing nip N. The other one of the heaters 23A and 23B includes a lateral end heat generation area spanning each end portion of the other one of the heaters 23A and 23B in the longitudinal direction thereof to heat toner images on large sheets P passing through the fixing nip N. In the present embodiment, the halogen heaters are used as the heaters 23A and 23B. Alternatively, the heaters may be induction heaters, resistance heat generators, carbon heaters, or the like.

In the fixing device 6, the stay 25 has a T-shaped cross-section. Specifically, the stay 25 includes an arm portion 25*a* projecting from a base portion of the stay 25 away from the fixing nip N. The arm portion 25*a* is interposed between the heaters 23A and 23B, thus separating the heaters 23A and 23B from each other.

A power supply situated inside the image forming apparatus 1 supplies power to the heaters 23A and 23B so that the heaters 23A and 23B generate heat. A controller operatively connected to the heaters 23A and 23B and the temperature sensor controls the heaters 23A and 23B based on the temperature of the outer circumferential surface of the fixing belt 21, which is detected by the temperature sensor disposed opposite the outer circumferential surface of the fixing belt 21. Such heating control of the heaters 23A and 23B adjusts the temperature of the fixing belt 21 to a desired fixing temperature.

The reflectors 26A and 26B are interposed between the stay 25 and the heaters 23A and 23B, respectively, to reflect light radiated from the heaters 23A and 23B toward the fixing belt 21, thereby enhancing heating efficiency of the heaters 23A and 23B to heat the fixing belt 21. The reflectors 26A and 26B prevent light and heat radiated from the heaters 23A and 23B from heating the stay 25, reducing energy waste.

The nip formation member 24 having the aforementioned configuration is applicable to the fixing device 6 described above and can give the effects described above. For example, the fastening hole 41*a* is designed as a non-penetrating hole. The non-penetrating hole prevents the thermal equalizer 42 from partially increasing in temperature and deforming. As a result, the image fixing failure and the acceleration of the wear of the fixing belt can be prevented.

The image forming apparatus 1 according to the present embodiments of the present disclosure is applicable not only to a color image forming apparatus illustrated in FIG. 1 but also to a monochrome image forming apparatus, a copier, a printer, a facsimile machine, or a multifunction peripheral including at least two functions of the copier, printer, and facsimile machine.

The sheets P serving as recording media may be thick paper, postcards, envelopes, plain paper, thin paper, coated paper, art paper, tracing paper, overhead projector (OHP) transparencies, plastic film, prepreg, copper foil, and the like.

A device including the heating device that includes the nip formation member according to the present disclosure is not limited to the fixing device described in the above embodiment. The heating device that includes the nip formation member according to the present disclosure is also applicable to a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the present disclosure to each of the above-described devices can uniform a temperature distribution of the high thermal conductive member in the device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A nip formation member configured to be disposed inside a loop of a rotatable belt, the nip formation member comprising:

a base having a bottomed fastening hole;

a thermal equalizer configured to face the belt and a surface of the base not having the bottomed fastening hole, the thermal equalizer having a higher thermal conductivity than the base;

an attachment having a fastening hole and facing another surface of the base having the bottomed fastening hole, the attachment configured to fix and position the base and the thermal equalizer; and a fastener fastened to the bottomed fastening hole of the base through the fastening hole of the attachment from the attachment, wherein the attachment and the base have steps shaped corresponding to each other.

2. The nip formation member according to claim 1, wherein the base is in contact with the thermal equalizer over a longitudinal direction of the thermal equalizer.

3. The nip formation member according to claim 1, wherein the base is in contact with the thermal equalizer at a position corresponding to the bottomed fastening hole of the base.

4. A heating device comprising:

a rotatable belt;

an opposed rotator arranged to face the belt; and the nip formation member according to claim 1, wherein the nip formation member is in contact with the opposed rotator via the belt to form a nip between the belt and the opposed rotator.

5. The heating device according to claim 4, further comprising a support configured to support the nip formation member from a side opposite to the nip, wherein the support is disposed away from the fastener with a gap in an insertion direction in which the fastener is inserted into the base.

6. The heating device according to claim 5, wherein a distance of the gap between the support and the fastener in the insertion direction is smaller than a length of a fastening portion of the fastener.

7. A fixing device comprising the heating device according to claim 4 configured to fix toner on a recording medium by heat.

8. An image forming apparatus comprising the fixing device according to claim 7.

9. A nip formation member configured to be disposed inside a loop of a rotatable belt, the nip formation member comprising:

a base having a bottomed fastening hole;

a thermal equalizer configured to face the belt and a surface of the base not having the bottomed fastening hole, the thermal equalizer having a higher thermal conductivity than the base;

an attachment having a fastening hole and facing another surface of the base having the bottomed fastening hole, the attachment configured to fix and position the base and the thermal equalizer; and a fastener fastened to the bottomed fastening hole of the base through the fastening hole of the attachment from the attachment, wherein the attachment has an end face downstream in a direction of movement of the attachment when the attachment is assembled to the thermal equalizer, and the thermal equalizer has a contact target face, and wherein, when the end face is in contact with the contact target face, the fastening hole of the attachment and the bottomed fastening hole of the base are positioned in the direction of movement of the attachment.

10. The nip formation member of claim 9, wherein the base is in contact with the thermal equalizer over a longitudinal direction of the thermal equalizer.

11. The nip formation member of claim 9, wherein the base is in contact with the thermal equalizer at a position corresponding to the bottomed fastening hole of the base.

12. A heating device, comprising:

a rotatable belt;

an opposed rotator arranged to face the belt; and the nip formation member according to claim 9, wherein the nip formation member is in contact with the opposed rotator via the belt to form a nip between the belt and the opposed rotator.

13. The heating device according to claim 12, further comprising a support configured to support the nip formation member from a side opposite to the nip, wherein the support is disposed away from the fastener with a gap in a insertion direction in which the fastener is inserted into the base.

14. The heating device according to claim 13, wherein a distance of the gap between the support and the fastener in the insertion direction is smaller than a length of a fastening portion of the fastener.

15. A fixing device comprising the heating device according to claim 12 configured to fix toner on a recording medium by heat.

16. An image forming apparatus comprising the fixing device according to claim 15.

* * * * *